US007886995B2

(12) United States Patent
Togashi

(10) Patent No.: US 7,886,995 B2
(45) Date of Patent: Feb. 15, 2011

(54) CONTENT DISCHARGE MECHANISM AND AEROSOL TYPE PRODUCT AND PUMP TYPE PRODUCT EQUIPPED WITH THE MECHANISM

(75) Inventor: Hideo Togashi, Tokyo (JP)

(73) Assignee: Mitani Valve Co. Ltd., Tokyo (JP)

( * ) Notice: Subject to any disclaimer, the term of this patent is extended or adjusted under 35 U.S.C. 154(b) by 89 days.

(21) Appl. No.: 11/969,685

(22) Filed: Jan. 4, 2008

(65) Prior Publication Data

US 2008/0121738 A1 May 29, 2008

Related U.S. Application Data

(63) Continuation-in-part of application No. PCT/JP2005/020121, filed on Nov. 1, 2005.

(30) Foreign Application Priority Data

Jul. 6, 2005 (JP) ..... 2005-197530

(51) Int. Cl.
*B05B 1/34* (2006.01)

(52) U.S. Cl. ..... 239/463; 239/491; 239/493; 239/392; 239/396; 239/490; 239/469; 239/497; 222/321.8

(58) Field of Classification Search ..... 239/491, 239/493, 392, 396, 490, 469, 463, 488, 398, 239/484, 486, 487, 483, 476, 501, 516, 466, 239/467, 333, 402, 399, 492; 222/321.8
See application file for complete search history.

(56) References Cited

U.S. PATENT DOCUMENTS 3,081,952 A * 3/1963 Woodward et al. ..... 239/464
3,112,074 A * 11/1963 Green ..... 239/493
3,129,893 A * 4/1964 Green ..... 239/490
3,625,437 A * 12/1971 Garrigou ..... 239/469
4,074,861 A * 2/1978 Magers et al. ..... 239/492
4,801,093 A * 1/1989 Brunet et al. ..... 239/490
4,961,727 A * 10/1990 Beard ..... 604/75
5,224,471 A * 7/1993 Marelli et al. ..... 128/200.14
5,622,318 A * 4/1997 Bougamont et al. ..... 239/490
5,711,488 A * 1/1998 Lund ..... 239/333
5,738,282 A * 4/1998 Grogan ..... 239/492
5,769,325 A * 6/1998 Jouillat et al. ..... 239/337
5,992,765 A * 11/1999 Smith ..... 239/493
6,241,165 B1 * 6/2001 Bickart et al. ..... 239/491
2003/0155434 A1 * 8/2003 Rini et al. ..... 239/398
2009/0057447 A1 * 3/2009 Lowry et al. ..... 239/601

* cited by examiner

*Primary Examiner*—Len Tran
*Assistant Examiner*—Trevor E McGraw
(74) *Attorney, Agent, or Firm*—Lucas & Mercanti, LLP

(57) ABSTRACT

A spray nozzle mechanism capable of forming spray contents into fine particles. A channel setting core is fixedly placed in a space in a button body, between an output hole of a vertical path and a hole for discharging contents to the external space. Swirls in the same swirling direction are formed by upstream recessed paths continuous from the vertical path and downstream recessed paths continuous to the discharge hole. Also, the spray nozzle mechanism has ribs. The ribs move initial swirls created by the upstream recessed paths to the corresponding downstream recessed paths, where the initial swirls are moved in a state where they are separated as far as possible.

5 Claims, 5 Drawing Sheets

CONTENT DISCHARGE MECHANISM AND AEROSOL TYPE PRODUCT AND PUMP TYPE PRODUCT EQUIPPED WITH THE MECHANISM

TECHNICAL FIELD OF THE INVENTION

The present invention relates to a content discharge mechanism for making a fine mist from a discharge content to be discharged to an external space, and more particularly to a spray nozzle for use with an aerosol type product and a pump type product.

BACKGROUND OF THE INVENTION

Spray nozzle generate a strong spiral discharge swirl flow by making a swirl flow (initial swirl flow) of the contents on the output side of a content passage which then moves a discharge hole due to pressing of the push button, the actuation mode setting. The nozzle design imparts additional swirl in the same direction as the initial swirl flow just short of the hole.

Further, the initial swirl flow on the output side of the content passage is substantially divided to a plurality of flows in the same swirl direction (a swirl flow not going round a swirl object plane). These swirl flows are joined just short of the discharge hole.

In the present specification, the term "swirl flow" includes a flow in a swirl direction that does not go round a swirl object plane as described above.

Moreover, the side of the discharge hole for a container content is assumed to be "front" and the opposite side "rear". That is, the left side in FIGS. 1 and 2 means "front" and the right side "rear".

The "pump type" indicates a system where the volume of a content accommodating space is reduced by pressing, for example, a peripheral part of a container is pressed by a user and the con-tents in the container is discharged to an external space.

Furthermore, an operation member for actuation mode setting includes push button type ones moving downward in operation and trigger lever type ones that rotate in operation.

Conventionally, a spray nozzle mechanism for aerosol type containers intended to atomize a content into a spray are known, for example in Japanese Unexamined Utility Model Application No. HEI3-32959.

As shown in the '959 application, a conventional spray nozzle mechanism is constructed as shown in FIGS. 5-10:

A columnar top [3'] for atomization of a spray content is disposed in a cylinder chamber [12] between a beak cylinder [1'] having an injection hole [13] formed in a front end wall [11] and an outlet side part of an injection passage of a push button [4]. A recessed cavity or cave [32] and a plurality of tangential grooves [34] communicating with the former, are formed in a front wall surface [35] of the top [3']/the front wall surface [35] and a rear wall surface [36] of the same. The tangential groove [34] is disposed to be antisymmetrical between the front wall surface [35] and the rear wall surface [36]. The top [3'] is rotated by the action of pressurized fluid (content) passing through the tangential groove [34].

The content in the container sent from the stem side is, in the case where the cave [32] and the tangential groove [34] are formed also in the rear wall surface [36], sprayed into the external space through a route of a spray passage [21]—he cave [32] in the rear wall surface [36]—the tangential groove [34] of the rear wall surface [36]—a space region among the external peripheral surface, the beak cylinder [1'], and the internal peripheral surface—the tangential groove [34] of the front wall surface [35]—the cave [32] of the front wall surface [35]—the spray hole [13].

The content (pressurized fluid) entering the cave [32] from a plurality of the tangential grooves [34] in the front wall surface [35] forms a swirl flow along its peripheral wall and is discharged from the spray hole [13] into the external space as fine mist.

OBJECTS OF THE INVENTION

The prior art nozzle mechanism for atomizing spray content experiences reverse phases in the disposition of a plurality of the tangential grooves in the front wall surface [35] and that of the tangential groove [34] in the rear wall surface [36], which does not utilize swirl flows based on the tangential grooves in the opposite surfaces synergetically.

It is an object of the present invention to provide a content discharge mechanism for making effective fine mist discharge operation of a container content by (a) fixedly disposing a core-shaped member (corresponding to the aforementioned top [3']) for flow passage setting in a space region (corresponding to the aforementioned cylinder chamber [12]) between an output part of a content passage region of and a content discharge hole part to an external space to produce swirl flows in the same rotation direction at an upstream side flow passage part, continuous from the content passage region and at downstream side flow passage part, continuous to the content discharge hole part; and (b) moving a plurality of initial swirl flows produced at the upstream side flow passage part to a corresponding swirl flow production part of the downstream side flow passage part in a separated state.

SUMMARY OF THE INVENTION

These another objects are obtained by the spray nozzle of the present invention. Broadly, the present invention is designed as a content discharge mechanism comprises:

1. a member for passage including a downstream passage region of a content and a sheath-shaped space region on a bottom surface of which an output part of the downstream passage region is formed;

2. a sheath-shaped discharge member attached to the sheath-shaped space region with its side of said output part being opened and including a hole for content discharge formed in its bottom surface on an external space side located oppositely to the side of the output part;

3. a core-shaped member making contact with respective bottom portions of the sheath-shaped space region and the discharge member and fixed to the member for passage and the discharge member to produce the space for passage of the content between it and an internal peripheral surface of the discharge member;

4. a plurality of upstream side passages provided on at least one of abutment parts of the member for passage and the core-shaped member so as to communicate the output part of the downstream passage region and the space for passage; and 5. a plurality of downstream side passages provided on at least one of the abutment parts of the discharge member and the core-shaped member for guiding the content advancing from the space for passage in the form of a spiral flow to the hole part for content discharge in the same direction as the spiral flow.

6. More, preferably, a plurality of rib-shaped parts are formed on at least one of the internal peripheral surface of the discharge member and an external peripheral surface for individually restricting a flow of the con-tent from each of the upstream side passages and for guiding and holding the core-shaped member.

The content discharge mechanism described above, and an aerosol type product and a pump type product both including the content discharge mechanism are objects of the present invention.

EFFECT OF THE INVENTION

In accordance with the present invention, as described above, the sheath-shaped nozzle piece etc. having the discharge hole part of the content into the external space and the core-shaped member therein are fixed in the sheath-shaped space on the output side of the push button body having the content passage region, and the content is sent to the discharge hole part after the content is made the initial spiral flow at an output side part of the button body etc. and at a front part (just upstream side) of the discharge hole this is further developed into a strong discharge spiral flow in the same direction.

A plurality of the initial swirl flows generated at the output side part are moved to a corresponding input side of the spiral flow generation part of a front part (just upstream part) of the discharge hole part, as well separated as possible, based on the action of the rib-shaped member set in the passage space region thereof.

It is hereby possible to make a content discharged into an external space fine mist by enabling a content sent from the container body side to be supplied to the discharge hole part in a strong discharge swirl flow in the form of evolved initial spiral flow thereof.

BRIEF DESCRIPTION OF THE DRAWINGS

These and other aspects of the present invention may be more fully understood by reference to one or more of the following drawings.

DESCRIPTION OF REFERENCE CHARACTERS

The following constituent components indicated by reference numbers each with an alphabet (e.g., discharge hole 2*a*) denote parts of those without alphabet (e.g., nozzle piece).

1: push button body equipped with a mechanism for making discharge content fine mist

1*a*: vertical passage of a content

1*b*: output hole part of the vertical passage

1*c*: downstream side sheath-shaped space region

1*d*: bottom surface part (of the sheath-shaped space region) having the output hole part substantially at the center thereof

1*e*: linear upstream side recessed passages (four) formed on the bottom surface part extending from the output hole part to an internal peripheral surface side of the sheath-shaped space region

Figure 3:
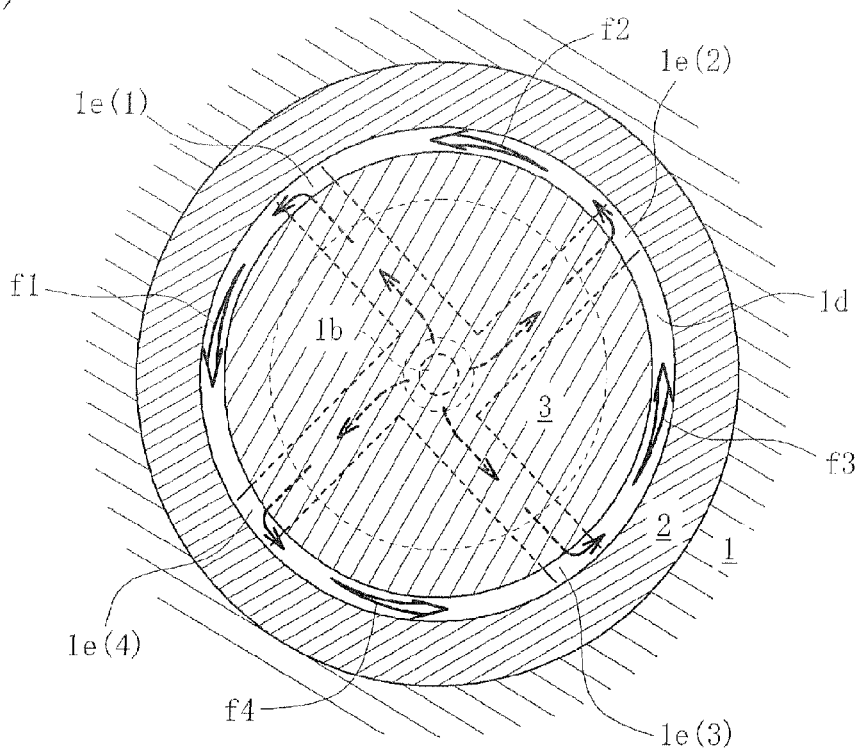
FIG. 3 illustrates cross sections of an input side and output side of the mechanism wherein (a) is a view illustrating an input side cross section based on a chain line A-A' of FIG. 2 and (b) a view illustrating an output side based on a chain line B-B' of FIG. 2.
Figure 3:
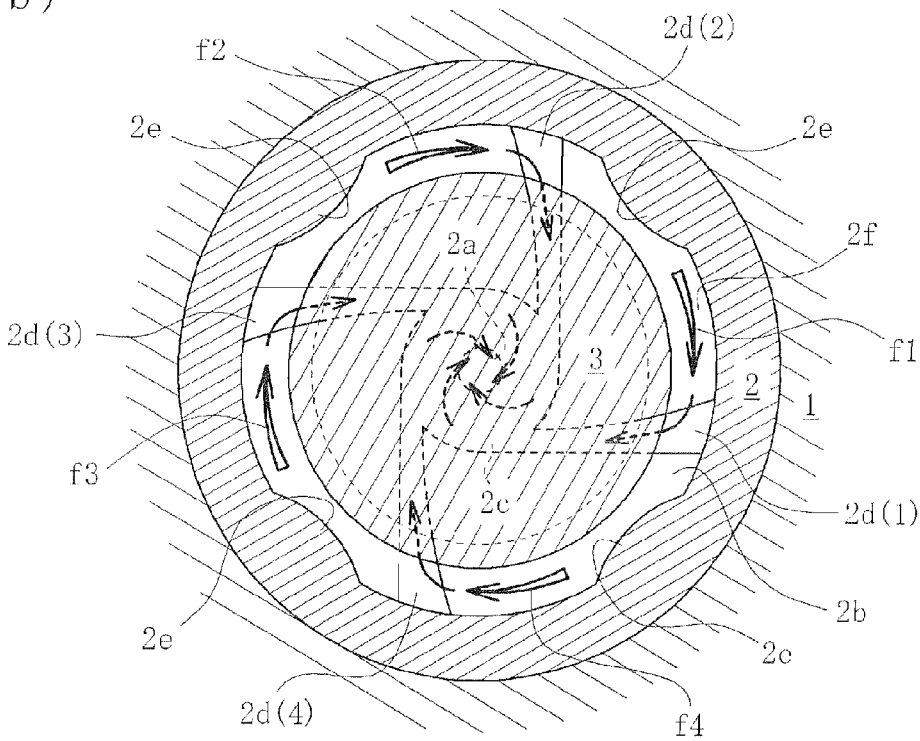
Figure 4:
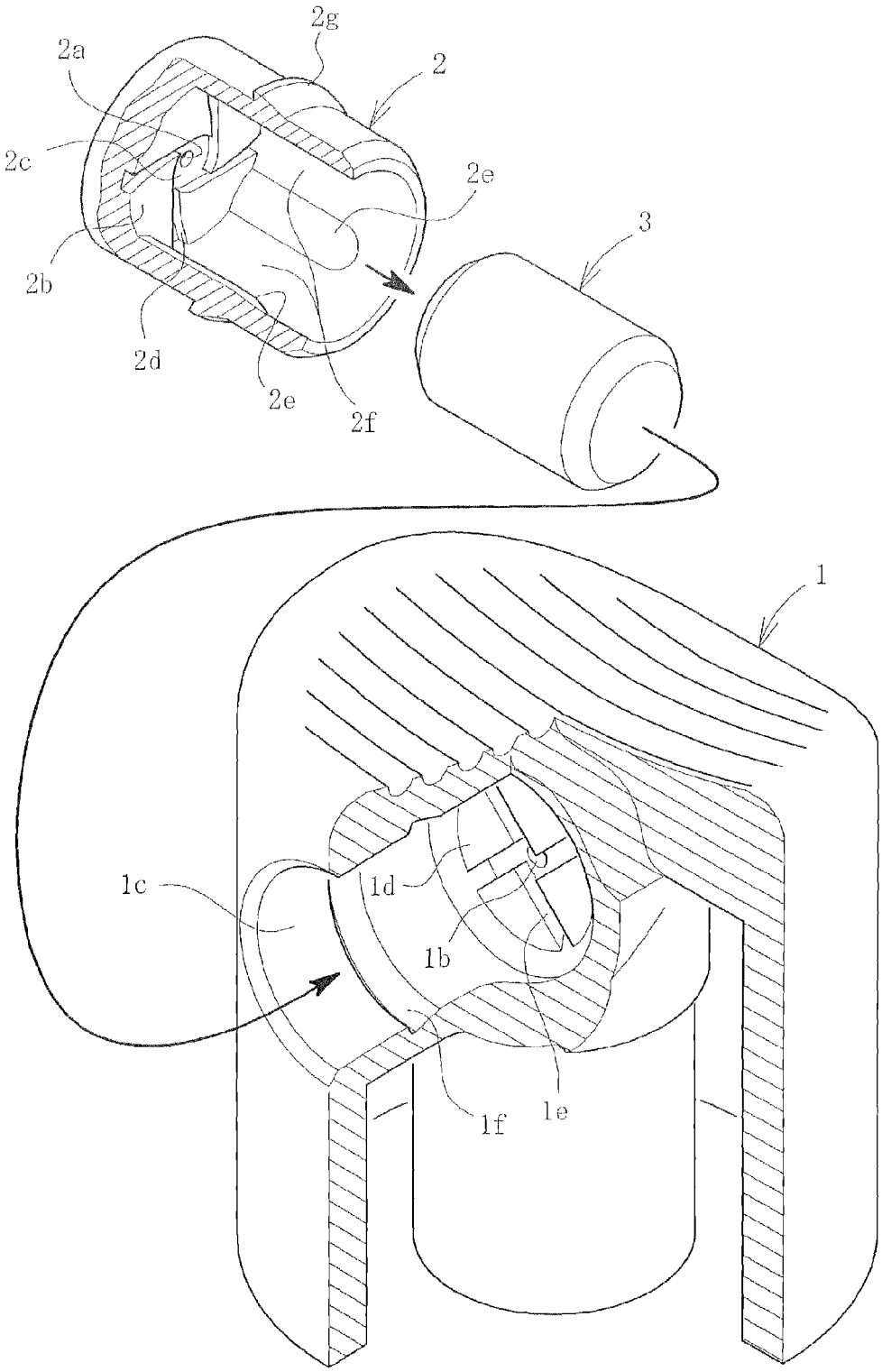
FIG. 4 is a view illustrating each constitutional component of the mechanism of FIG. 1, and FIGS. 5-10 illustrate a nozzle for the background of the Invention.
Figure 5:
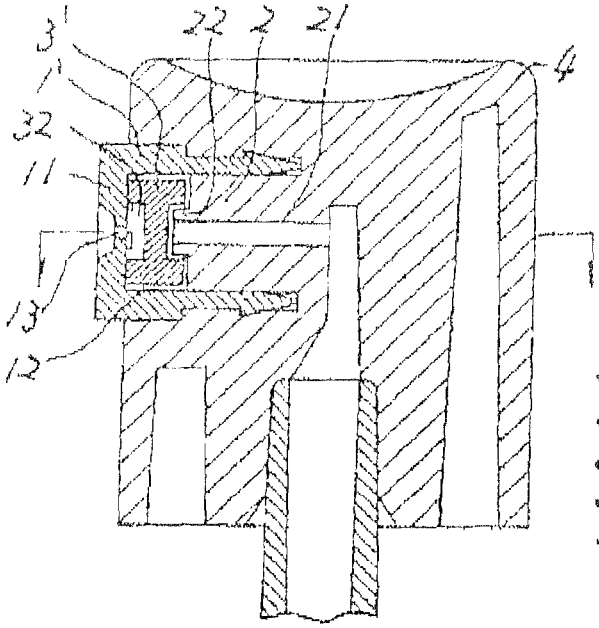
FIG 5 Prior Art
Figure 7:
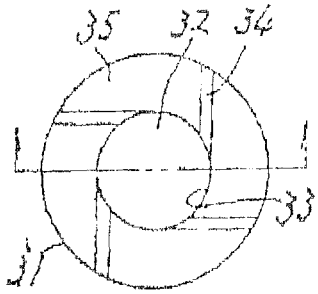
FIG 7 Prior Art
Figure 8:
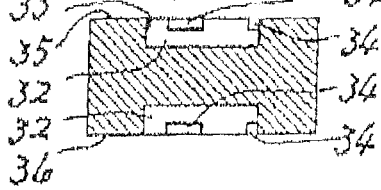
FIG 8 Prior Art
Figure 9:
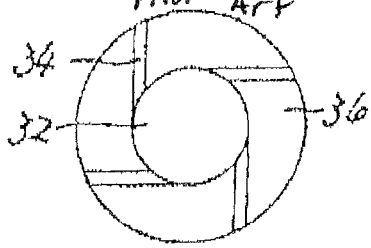
FIG 9 Prior Art
Figure 6:
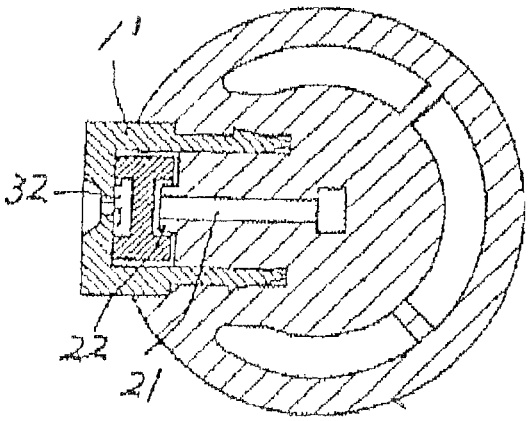
FIG 6 Prior Art
Figure 10:
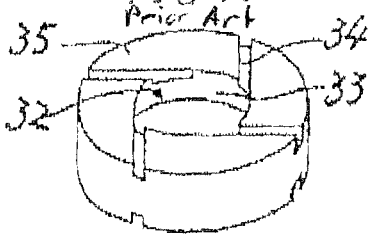
FIG 10 Prior Art

1*e*(1) to 1*e*(4): upstream side recessed passage (only FIG. 3)

1*f*: annular recessed part engaging with stepped annular protruded part 2*g* of a nozzle piece 2 described later

2: sheath-shaped nozzle piece united engaged with the sheath-shaped space region 1*c*

2*a*: discharge hole for content

2*b*: bottom surface part having the discharge hole substantially at the center thereof

2*c*: circular recessed part formed in the bottom surface part in the form of surrounding the discharge hole

2*d*: downstream side recessed passages (four) each formed in the bottom surface part from the internal peripheral surface side of the nozzle piece to the circular recessed part

2*d*(1) to 2*d*(4): downstream side recessed passage (only FIG. 3)

2*e*: longitudinal ribs (four) having a function of regulating a swirl flow of contents formed longitudinally of the internal peripheral surface and sent from the upstream recessed passage 1*e*, of reducing mixing of initial swirl flows as mush as possible, and of guiding and holding a core 3 described later

2*f*: space regions (four) for content passage formed between the ribs in the state where the core is maintained as illustrated in the figure

2*g*: stepped annular protrusion for engagement with the push button body 1

3: columnar core fixed in contact with a bottom surface part 1*d* of the push button body 1, a bottom surface part 2*b* of the nozzle piece 2, and each of the ribs 2*e*

4: stem fixed below the vertical passage 1*a* of the pushbutton body 1 for changing well known changeover means (changeover between a stem gasket and a stem hole part in case of an aerosol container; changeover of a downstream valve in case of a pump container) from a previous closed state to an open state of the actuation mode following press operation of the push button f1 to f4 initial swirl flow (only FIG. 3)

DETAILED DESCRIPTION OF THE INVENTION

Preferred embodiments of the present invention will be described with reference to FIGS. 1 to 4.

It is fundamental features of the present invention corresponding to the embodiments that 1. the core 3 for flow passage setting is fixedly disposed in the space region between the output hole part 1*b* of the vertical passage 1*a* of the button body 1 and the discharge hole 2*a* of a content into the external space. The swirl flows in the same rotation direction are respectively formed through the upstream side recessed passage 1*e* continuously extending from the vertical passage 1*a* and through the downstream side recessed passage 2*d* extending to the discharge hole 2*a*. The rib 2*e* is formed for moving a plurality of the initial swirl flows produced through the upstream side recessed passages 1*e*(1) to 1*e*(4) to the corresponding downstream side recessed passages 2*d*(1) to 2*d*(4). These passages are separated from each other as far as possible.

Material qualities of the push button body 1, nozzle piece 2, core 3, and stem 4 are of plastic such as polypropylene, polyethylene, nylon, polyacetal, polybutylene terephthalate.

The content flow passage from the stem 4 to the discharge hole 2*a* is the content passage of the stem 4—vertical passage 1*a* of the push button body 1—its output hole part 1*b*—upstream side recessed passage 1*e*—space region 2*f* of the color member 2—downstream side recessed passage 2*d*—circular recessed part 2*c*—discharge hole 2*a*.

The upstream side recessed passage 1*e* of the push button body 1 has substantially the same cross sectional area for content passage at respective longitudinal positions. The downstream side recessed passage 2*d* of the nozzle piece 2 has a cross sectional area for content passage which is smaller, closer to the circular recessed part 2*c* than that far away from the circular recessed part 2*c* as shown in FIG. 3(*b*).

The four linear upstream side recessed passages 1*e* are formed at an equal interval on the bottom surface part 1*d* of the sheath-shaped space region 1*c*. The longitudinal central lines of passage 1*e* are shifted, so to speak, by the same phase from a radial direction of the bottom surface part (taking the output hole part 1*b* as a center). In other words, the longitudinal central line of the upstream side recessed passage 1*e* is prevented from intersecting the output hole part 1*b*.

More specifically, when a content passing through the upstream side recessed passage 1*e* strikes the internal peripheral surface of the sheath-shaped space region 1*c*, angles formed by a striking direction (flow direction of the content) and struck part are different at opposite sides of the struck part.

Therefore for contents striking the internal peripheral surface of the sheath-shaped space region 1*c* from the upstream side recessed passage 1*e* those swirling in a large angle direction form a main current (refer to FIG. 3(*a*)). The contents also undergo, as it were, drive force in a front direction owing to the action of a tapered surface of the struck part (refer to FIG. 2).

Figure 1:
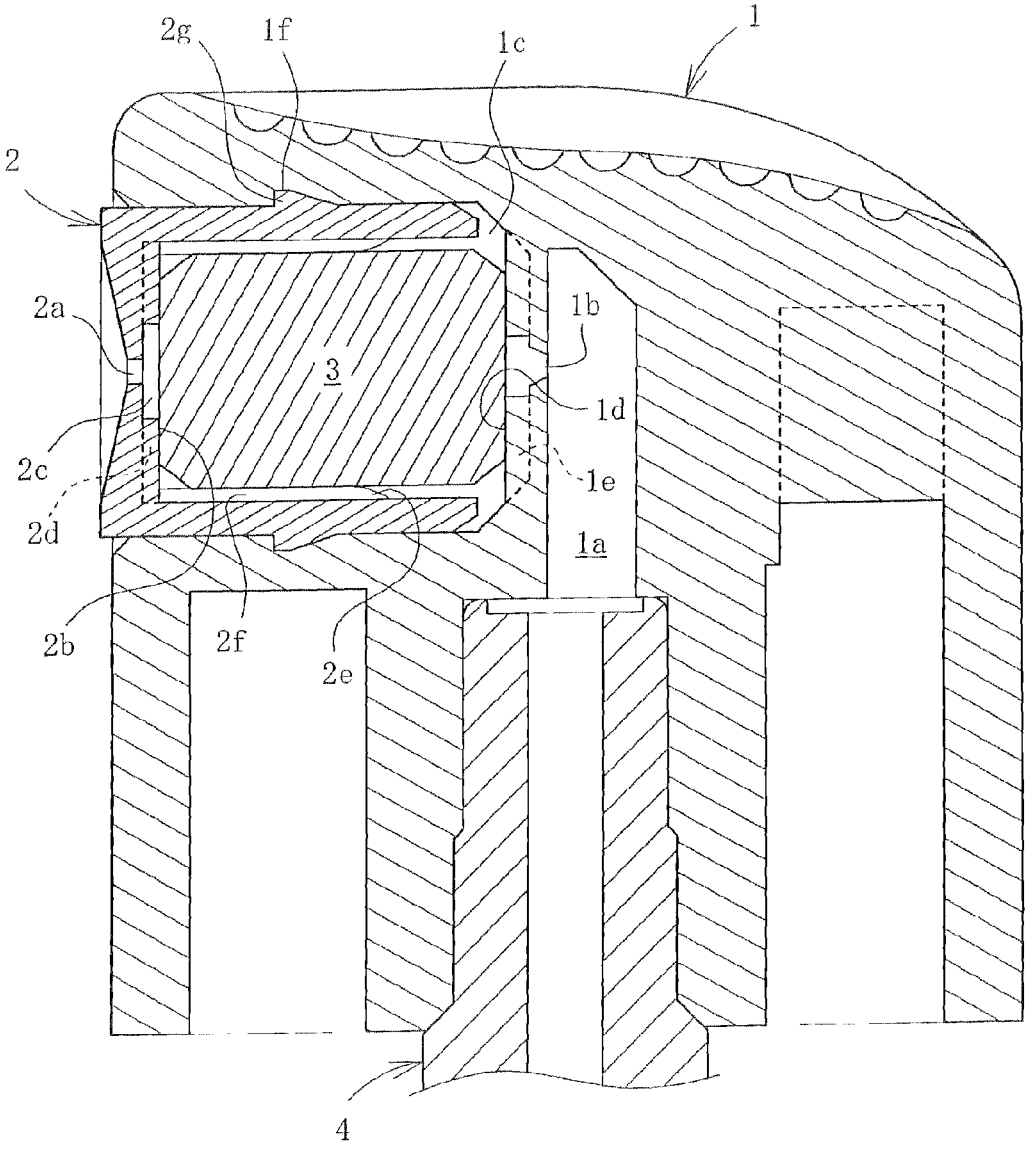
FIG. 1 is a view illustrating a cross section of a push button equipped with a mechanism for making a discharge content fine mist.
Figure 2:
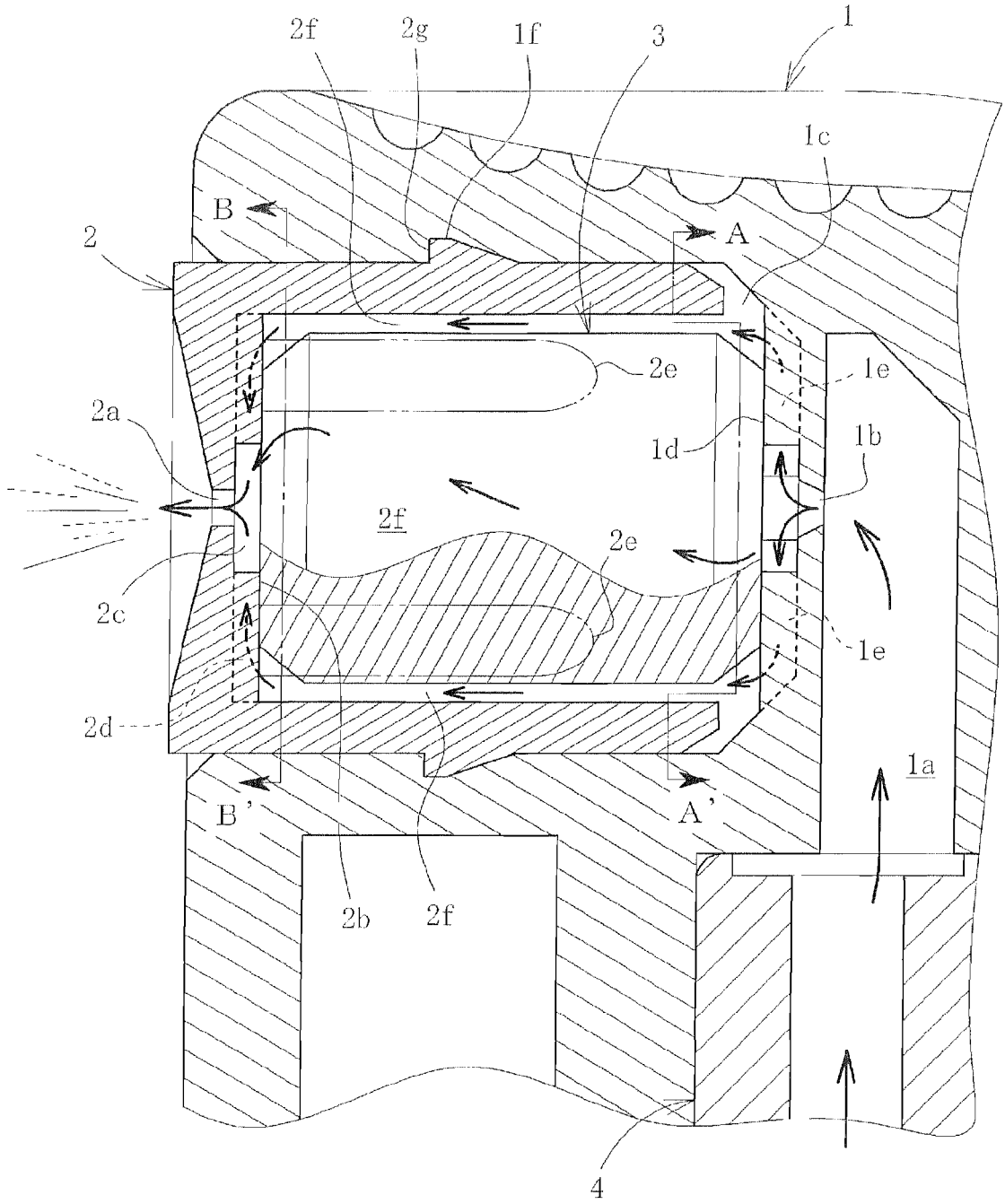
FIG. 2 is a view illustrating the mechanism for making a discharge content fine mist.

The contents, form the initial swirl flow like this, advances in one space region 2*f* as indicated by an arrow in FIG. 2 and enters the corresponding downstream side recessed passage 2*d* of the nozzle piece 2

There is herein illustrated in FIG. 3 correspondence between the four upstream side recessed passages 1*e*(1) to 1*e*(4)/down stream side recessed passages 2*d*(1) to 2*d*(4) and the initial swirl flows f1 to f4. Reference numbers with the same sub-numbers correspond to each other, e.g. the initial swirl flow f1 from the upstream side recessed passage 1*e*(1) enters the downstream side recessed passage 2*d*(1). It is herein noticed that the initial swirl flows f1 to f4 form substantially independent flows as a result of the separation action of the four ribs 2*e*.

Each of the initial swirl flows f1 to f4 entering the downstream side recessed passages 2*d*(1) to 2*d*(4) becomes a large single discharge swirl flow in the same direction at the circular recessed part 2*c* located and the contents becoming a fine mist that is sprayed into the external space from the discharge hole 2*a*.

It is of course that the present invention is not limited to the disclosures illustrated in FIGS. 1 to 4. For example, the upstream side recessed passage 1*e* may be formed in opposite abutment surface (with the bottom surface part) of the core 3 instead of the bottom surface part 1*d* of the sheath-shaped space region 1*c* and the bottom surface part of the nozzle piece 2. Additionally, they may be formed in both of the bottom surface part and the opposite abutment surface. Additionally, the rib 2*e* may be formed on the external peripheral surface of the core 3 instead of the internal peripheral surface of the nozzle piece 2. Also, they may be formed in both of the internal peripheral surface and in the external peripheral surface. Further more, the rib 2*e* may be an inclined form from the lateral direction in the figure (=longitudinal direction of the nozzle piece 2 and the core 3).

The physical nature of the container contents include liquids, expandable foam, pastes, gels, and powders.

Aerosol type products and pump type products to which the present invention is applicable include cleansing agents, cleaning agents, antiperspirants, coolants, muscle antiphlogistic agents, hair styling agents, hair treatment agents, hair washing agents, hair restorers, cosmetics, shaving foams, foods, droplet like products (such as vitamin), medical goods, quasi drugs, coating materials, gardening agents, repellant agents (insecticides), cleaners, deodorants, laundry starch, urethane foams, extinguishers, adhesives, lubricant agents or the like.

Contents in the container can include powdery products, oil components, alcohols, surfactants, high polymers, and effective components associated with various applications.

Powdery products includes metal salts powder, inorganic powder, and resin powder or the like, e.g. talc, kaolin, aluminum hydroxychloride (aluminum salt), calcium arginate, powdered gold, silver powder, mica, carbonate, barium sulphate, cellulose, and mixtures of them.

Oil components include silicone oil, palm oil, eucalyptus oil, camellia oil, olive oil, jojoba oil, paraffin oil, myristic acid, palmitic acid, stearic acid, linoleic acid, linolenic acid or the like.

Alcohols include monovalent lower alcohol such as ethanol, monovalent higher alcohol such as lauryl alcohol, and multivalent alcohol such as ethylene glycol or the like.

Surfactants include anionic surfactant such as sodium laurylsulphate, non-ionic surfactant such as polyoxyethylene oleyl ether, amphoteric surfactant such as lauryl dimethyl amino acetic acid betaine, and cationic surfactant such as alkylchloride trimethylammonium or the like.

Polymer molecule compounds include methylcellulose, gelatine, starch, and casein or the like.

Effective components associated with respective applications include antiphlogistics/analgesics such as methyl salicylate and indometacin, bacteria elimination agents such as sodium benzoate and cresol, harmful insect extermination agents such as pyrethroid, diethyltoluamide, anhidrotics such as zinc oxide, algefacient such as camphor and peppermint camphor, antiasthmatic agents such as ephedrine and adrenaline, edulcorant such as sucralose and aspartame, adhesive and paint such as epoxy resin and urethane, dyes such as paraphenylenediamine and aminophenol, and extinguishant such as ammonium dihydrogenphosphate and sodium/potassium acid carbonate or the like.

Further, the contents can include usable suspensions, UV absorbers, emulsifiers, humectants, antioxidants, and metal ion blocking agents, etc.

Content discharge gas in the aerosol type product includes carbon dioxide, nitrogen gas, compressed air, oxygen gas, rare gas, such as helium, neon, and argon, compressed gas of mixed gas etc. of the former gases, liquefied petroleum gas, and liquefied gas of dimethyl ether and fluorocarbon etc.

What is claimed:

1. A discharge mechanism of contents comprising:

an operation member having a passage region for contents, an output hole in the passage region, and an output side space region having a first bottom surface part that is a sheath-shaped space region extending from the output hole part to a downstream side thereof;

a sheath-shaped nozzle member mounted on said output side space region and having a second bottom surface part in which a discharge hole for said contents to an external space is formed;

a core mounted between said operation member and said sheath-shaped nozzle member that includes a first contact part making contact with said first bottom surface part and a second contact part making contact with said second bottom surface part to produce a passage space for said contents between an outer peripheral surface of said core and an inner peripheral surface of said sheath-shaped nozzle member;

a plurality of first downstream recessed passages outwardly extending from said output hole to said passage space provided on said first bottom surface part for generating an initial swirling flow of said contents in a first swirling direction from said output hole to said passage space; and a plurality of second downstream recessed passages inwardly extending from said passage space to said discharge hole provided on said second bottom surface part for generating a final swirling flow of said contents in same direction as said initial swirling flow from said passage space to said discharge hole.

2. The discharge mechanism according to claim 1, wherein a plurality of rib-shaped parts are formed on at least one of said internal peripheral surface of said sheath-shaped nozzle member and said outer peripheral surface of said core for regulating said initial swirling flow of said contents from said first downstream recessed passages and for guiding and holding said core.

3. An aerosol type product, including said discharge mechanism according to claim 1 and accommodating discharging gas and a content.

4. A pump type product, including said discharge mechanism according to claim 1 and accommodating a content.

5. The discharge mechanism according to claim 1, wherein the second downstream recessed passages are wider at the passage space than at the discharge hole.

* * * * *